US006252559B1

(12) United States Patent
Donn

(10) Patent No.: US 6,252,559 B1
(45) Date of Patent: Jun. 26, 2001

(54) MULTI-BAND AND POLARIZATION-DIVERSIFIED ANTENNA SYSTEM

(75) Inventor: Cheng Donn, Tustin, CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/559,463

(22) Filed: Apr. 28, 2000

(51) Int. Cl.[7] ..... H01Q 19/14

(52) U.S. Cl. ..... 343/781 CA; 343/781 P; 343/756; 343/909

(58) Field of Search ..... 343/781 CA, 781 R, 343/781 P, 756, 909, 910, 911 R; H01Q 19/14

(56) References Cited

U.S. PATENT DOCUMENTS

| | | | | |
|---|---|---|---|---|
| 3,209,355 | | 9/1965 | Livingston | 343/850 |
| 4,257,047 | | 3/1981 | Lipsky | 343/120 |
| 4,264,907 | | 4/1981 | Durand, Jr. et al. | 244/3.16 |
| 4,791,427 | | 12/1988 | Raber et al. | 343/754 |
| 5,061,930 | | 10/1991 | Nathanson et al. | 342/13 |
| 5,130,718 | * | 7/1992 | wu et al. | 343/781 CA |
| 5,307,077 | | 4/1994 | Branigan et al. | 343/720 |
| 5,373,302 | | 12/1994 | Wu | 343/909 |
| 5,384,575 | | 1/1995 | Wu | 343/909 |
| 5,673,056 | * | 9/1997 | ramanujam et al. | 343/756 |
| 5,717,405 | | 2/1998 | Quan | 342/373 |
| 5,751,254 | | 5/1998 | Bird et al. | 343/761 |
| 5,764,192 | | 6/1998 | Fowler et al. | 343/705 |
| 5,793,332 | | 8/1998 | Fowler et al. | 343/705 |
| 5,872,543 | | 2/1999 | Smith | 343/722 |
| 5,949,387 | | 9/1999 | Wu et al. | 343/909 |

* cited by examiner

*Primary Examiner*—Hoanganh Le
(74) *Attorney, Agent, or Firm*—Harness Dickey & Pierce P.L.C.

(57) ABSTRACT

A multiple band, polarization diversified antenna system that accommodates a plurality of independent and separate antenna subsystems that share a common aperture and boresight. The antenna system includes a first low-band antenna subsystem for one polarization mode in a low frequency band, a second low-band antenna subsystem for another polarization mode in the low frequency band and a high-band, dual-polarization, dual-reflector antenna subsystem for two high-frequency antenna subsystems having orthogonal polarization modes. The dual-reflector antenna subsystem includes a main reflector, a sub-reflector and a support cone. The two low-band antenna subsystems and the high-band, dual-polarization feed subsystems are all positioned behind the main reflector of the high-band dual-reflector antenna subsystem. The signals transmitted by the high-band antenna are directed towards the sub-reflector and are reflected therefrom to be directed towards the main reflector. The signals are reflected from the main reflector to be emitted toward free space from the antenna system through the support cone. The low-frequency signals pass through the main reflector, the sub-reflector and the support cone. The main reflector, the sub-reflector and the support cone are suitable frequency selective surfaces so that the main reflector and the sub-reflector are reflective to the high-frequency signals and are transparent to the low-frequency signals, and the support cone is transparent to both the high-frequency and low-frequency signals.

20 Claims, 3 Drawing Sheets

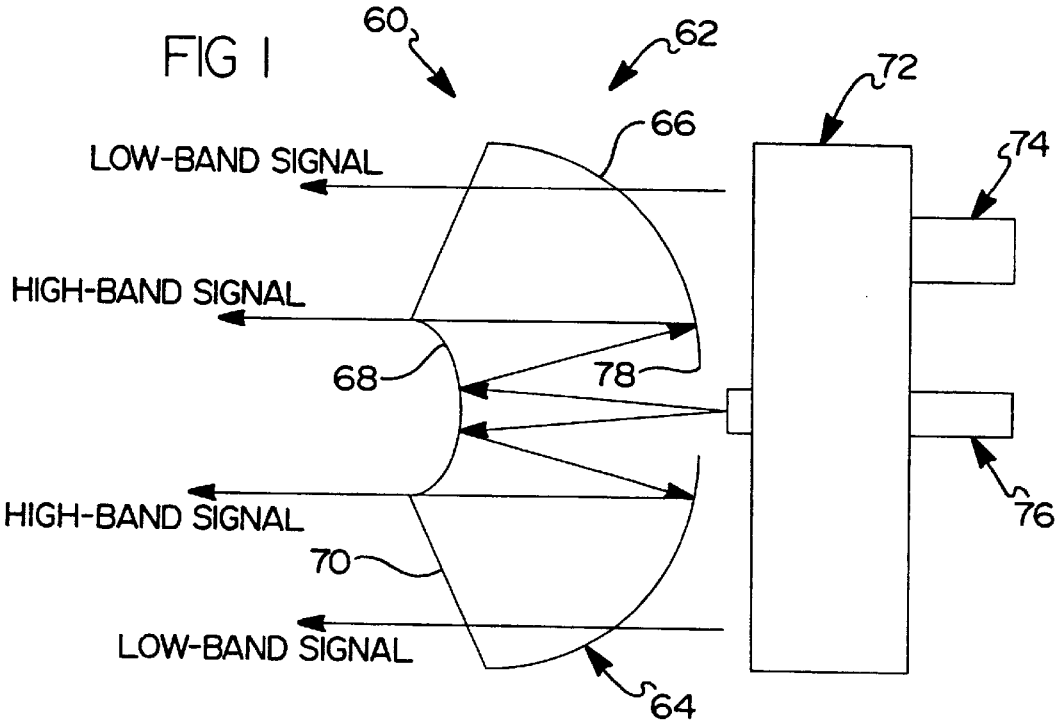
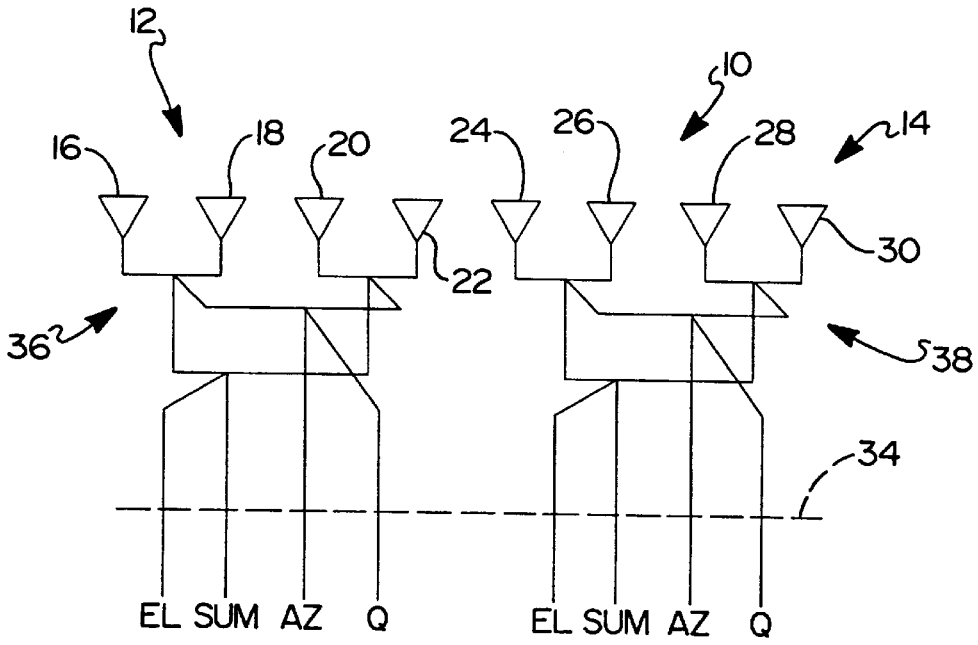
FIG 2

FIG 3
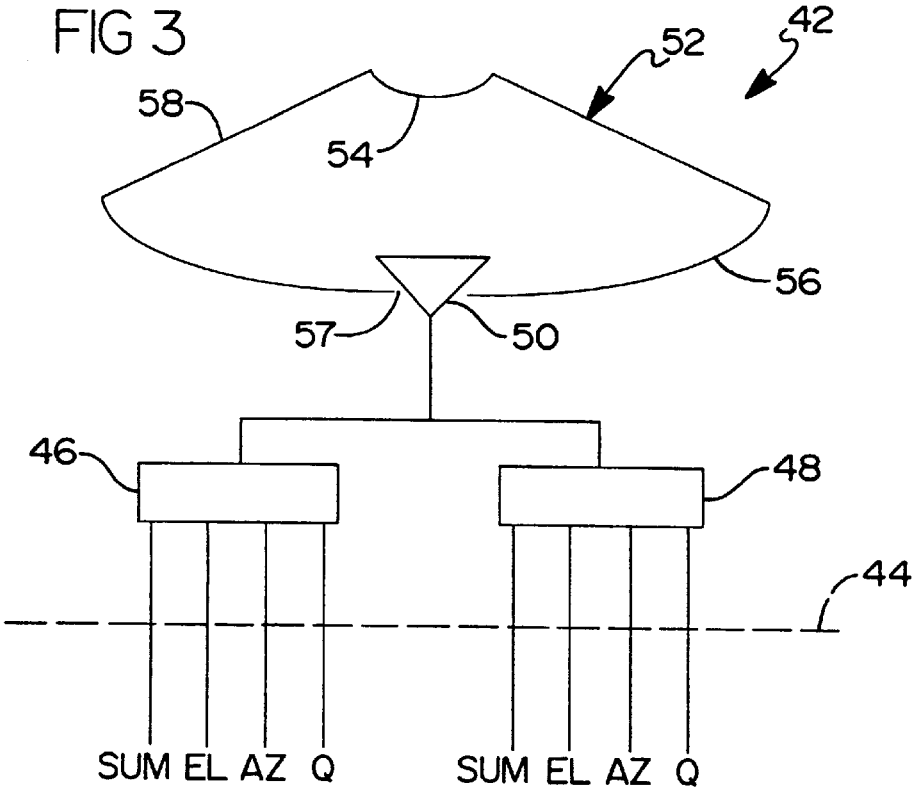
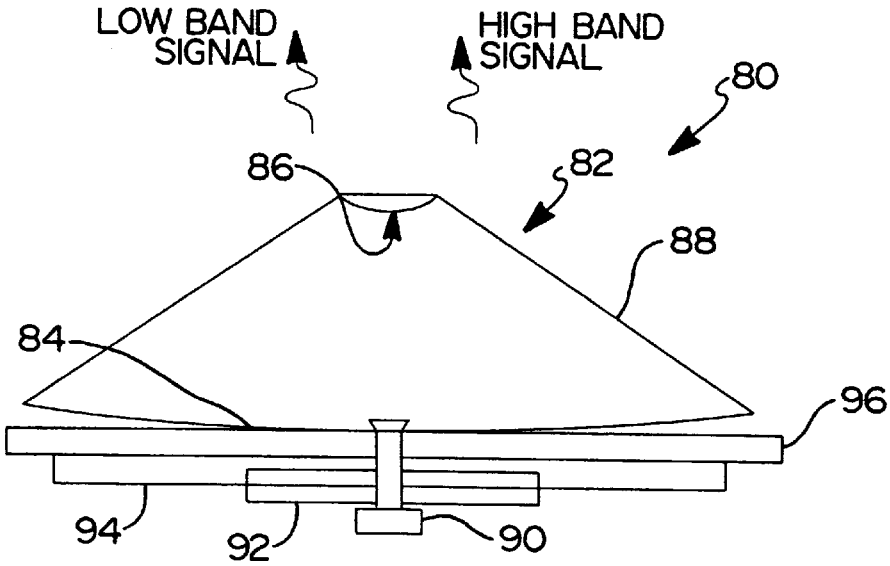
FIG 4

MULTI-BAND AND POLARIZATION-DIVERSIFIED ANTENNA SYSTEM

BACKGROUND OF THE INVENTION

1. Field of the Invention

This invention relates generally to a multiple frequency band and/or multiple polarization mode antenna system having multiple antenna subsystems for radar, remote sensing, communications or a combination of various applications, where each antenna subsystem (each band or mode) shares a common aperture and boresight, More particularly, the present invention relates to multi-band/dual-polarization radar antenna system for a radar seeker that employs properties of frequency selective surfaces to allow several antenna subsystems to use a common aperture and boresight.

2. Discussion of the Related Art

Many applications exist for the transmission and reception of signals for both radar and communications purposes. Radar systems are known to provide target tracking and acquisition. Various antenna configurations known in the art provide dual-band and dual-polarization functions for the radar systems. U.S. Pat. No. 5,451,969 issued to Toth et al. entitled "Dual Polarized Dual Band Antenna" discloses an antenna configuration for such an application.

Modern, advanced tactical missiles are typically equipped with a radar seeker to provide target acquisition and tracking functions, and also are outfitted with electronic-counter-counter-measure (ECCM) devices to mitigate known electronic-counter-measures (ECM), such as cross-eye, cross-polarization, towed decoy and terrain bouncing jamming, to achieve a desirable "hit-to-kill" ratio. To counter these existing and potential future threats, radar sensors with enhanced capabilities which can successfully function in an advanced ECM threat environment are needed for the next-generation advanced tactical missiles. To achieve this goal, an advanced multi-band and polarization-diversified radar antenna architecture is necessary.

Advanced multi-band/polarization-diversified radar antenna architectures possess many advantages over conventional antenna architectures. These advantages include providing up to four separate antennas sharing a single common aperture and operating at four different frequency bands with full aperture RF performance; providing any selected polarization for each antenna; providing a co-boresight for all four antenna beams; providing a compact volume/size for missile applications; providing enhanced anti-jamming capability in general; providing additional ECCM enhancements; and providing precision profiling of targets by high band channels with higher resolution during the terminal homing phase.

To make a multi-band/dual-polarization radar system, it is necessary to provide a multi-band/polarization-diversified antenna system which shares a given aperture with minimum antenna performance degradations in the presence of each different antenna. The use of frequency selective surfaces (FSS) offers a practical technique for integrating different frequencies and/or polarization modes in a multi-band/polarization-diversified antenna system. Properly designed FSS devices are able to pass signals at one frequency band and reflect or block signals at another frequency band, and are non-discriminative to various polarization modes, both linear and circular types, to both designed frequency bands. Antenna systems employing these types of FSS have been identified in the art, and are shown, for example, in U.S. Pat. Nos. 5,949,387 entitled "Frequency Selective Surface (FSS) Filter For An Antenna"; 5,497,169 entitled "Wide Angle, Single Screen, Gridded Square-Loop Frequency Selective Surface For Diplexing Two Closely Separated Frequency Bands" and 5,373,302 entitled "Double-Loop Frequency Selective Surface For Multi Frequency Division Multiplexing in A Dual Reflector Antenna".

SUMMARY OF THE INVENTION

In accordance with the teachings of the present invention, an antenna system architecture is disclosed that accommodates a plurality of independent and separate antennas that share a common aperture and boresight. In one embodiment, for radar applications, the antenna system includes two low-frequency antennas operating at frequencies F1 and F2 using the same or orthogonal polarization modes, and two high-frequency antennas operating at frequencies F3 and F4 using the same or orthogonal polarization modes. The low-frequency antennas, in general, are array antennas and the high-frequency antennas, most suitably, are dual reflector antennas such as Cassigrian or Gregorian reflector antennas. The dual reflector antenna includes a main reflector, a sub-reflector, a feed subsystem and a sub-reflector support structure, which can either be struts or a cone structure.

In the most practical configuration, the high-frequency reflector antenna is packaged immediately in front of the low-frequency antenna. For the transmitting case, the high-band feed subsystem is positioned at the focal point of the dual reflector antenna. Signals transmitted from the high-band feed subsystem are directed towards the sub-reflector, and are reflected therefrom towards the main reflector. The signals are then reflected from the main reflector in a collimated format and pass through the support structure towards free space. The low band signals from the low-frequency antenna, located behind the high-frequency reflector antenna, pass through the main reflector, the sub-reflector and the support structure towards free space. For the receiving case, the signals from free space are reflected by the main reflector and directed to the subreflector, then reflected by the subreflector to be collected by the feed subsystem. The main reflector, the sub-reflector and the support structure are suitable frequency selective surfaces so that the main reflector and the sub-reflector reflect the high band signals and are transparent to the low band signals. The support structure, however, requires being transparent to both the high-band and low-band signals. The use of an FSS cone surface as the subreflector support structure provides an additional ECCM enhancement by making the entire multi-band and polarization diversified antenna system a low observable target to any out-of-band hostile ECM system due to its FSS design and its conical shape.

Additional objects, features and advantages of the present invention will become apparent from the following description and appended claims, taken in conjunction with the accompanying drawings.

BRIEF DESCRIPTION OF THE DRAWINGS

FIG. 1 is an illustration of a multi-function antenna system employing frequency selective surfaces to combine low-band and high-band polarization diversified antenna systems, according to an embodiment of the present invention;

FIG. 2 is a functional block diagram of a low-band, dual-polarization antenna system;

FIG. 3 is a functional block diagram of a high-band, dual-polarization antenna system;

FIG. 4 is a plan view of a multi-band, polarization diversified antenna system employing a parabolic main reflector, according to an embodiment of the present invention;

DETAILED DESCRIPTION OF THE PREFERRED EMBODIMENTS

Figure 5:
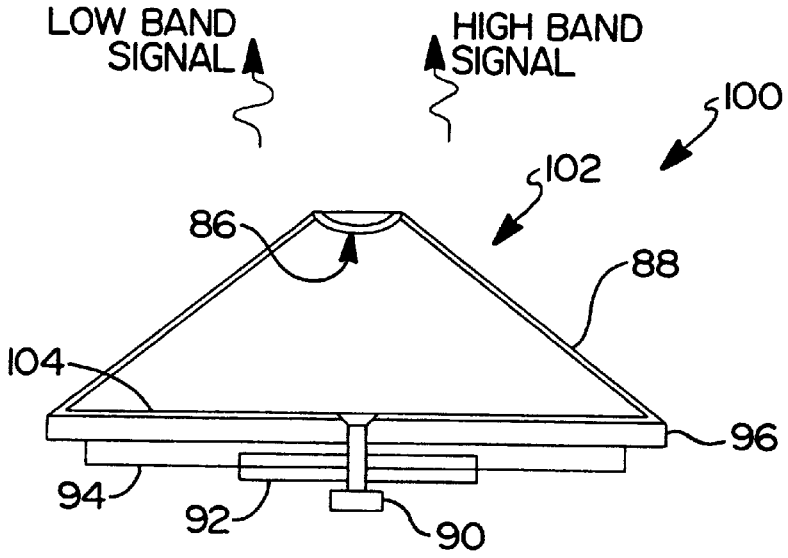
FIG. 5 is a plan view of dual-band, dual-polarization antenna system employing a flat main reflector in a Cassegrian reflector antenna system, according to another embodiment of the present invention.

The following discussion of the preferred embodiments directed to a multi-band, polarization diversified antenna system is merely exemplary in nature, and is in no way intended to limit the invention or its applications or uses. For example, the discussion below is directed towards a radar antenna system. However, the concept of the invention can be used in connection with other purposes, such as communications applications, remote sensing applications, etc.

The present invention describes a multi-band, polarization diversified antenna system that consists of four independent and separate antennas sharing the same aperture. The antenna system employs RF frequency bands, including microwave and millimeter wave frequency bands, etc., and has application for radar systems, communications systems, and remote sensing systems.

FIG. 1 is a plan view of an antenna system 60 according to an embodiment of the present invention. The antenna system 60 includes two high-band antennas 62 using two different frequency bands and/or two different polarization modes. The two high-band antennas 62 employ a dual reflector antenna system 64 having a main reflector 66, a sub-reflector 68 and a support cone 70, and a high-band feed subsystem 76. The feed subsystem 76 is positioned at a center opening 78 of the main reflector 66, which is the focal point of the dual reflector antenna system 64 as shown. The high-band feed subsystem 76 emits high frequency signals through the opening 78 in the main reflector 66 towards the sub-reflector 68. The high frequency signals are reflected off of the sub-reflector 68 and are directed towards the main reflector 66 to be reflected therefrom. The high-frequency signals reflected off of the reflector 66 pass through the support cone 70 into free space.

The antenna system 60 also includes two low-band antennas 72 having a low-band feed 74. The two low-band antennas 72 also use two different frequency bands, different than the high-bands, and/or two different polarization modes. A variety of closely packaged, separate antenna arrays can provide the two low-band antenna function. The low-band signals from the low-band feed 74 propagate directly through the main reflector 66, the sub-reflector 68 and the support cone 70 with minimal attenuation toward free space.

To accommodate both the low-band and high-band antennas 62 and 72, the sub-reflector 68, the main reflector 66, and the support cone 70 must be frequency selective surfaces that are polarization non-discriminatory. Particularly, the main reflector 66 and the sub-reflector 68 must reflect signals in the high-band frequency range and be transparent to signals in the low-band frequency range. Additionally, the support cone 70 must be transparent to signals in both the high-band and low-band frequency ranges and be polarization non-discriminatory. The frequency selective surfaces comprising the sub-reflector 68, the main reflector 66 and the support cone 70 can be any suitable frequency selective surfaces known in the art that operate in this manner, such as those discussed in the patents referenced above.

The antenna system 60 has particular application for a radar seeker providing target acquisition and tracking. The radar seeker antenna system of the invention includes, in one embodiment, two antennas operating at a low frequency band, where each low-band antenna has a separate polarization mode, and two antennas operating at a high frequency band, where each high-band antenna has a separate polarization mode. All four antennas individually utilize the full physical aperture of the antenna system for full RF performance. Each antenna provides a full monopulse function of four (4) channels, the SUM, delta AZ, delta EL and delta Q radar channels. With this full multi-band, polarization diversified architecture, it is possible to provide up to a sixteen-channel capability, four for each antenna at four separate frequency bands, to allow radar system engineers to configure many unique radar sensors for specific tailored applications. A plurality of separate antennas with full monopulse function, each including summation, AZ, EL and Q radar channels, provides system redundancy for anti-jamming and enhanced ECCM purposes in addition to enhanced radar system performance.

The discussion herein concerns providing several RF radar channels for target acquisition and tracking purposes, where the system is dual frequency and dual polarization. The polarizations can be vertically or horizontally linear polarization signals, or left hand circularly polarized (LHCP) or right hand circularly polarized (RHCP) signals. However, it is stressed that this is by way of example in that the various channels can be mixed and matched for different frequency bands and polarization modes for different applications. For example, the four (4) separate antennas can use the same frequency band, but use four different polarization modes, or the four (4) separate antennas can use four different frequency bands having the same polarization mode, or any combination thereof.

FIG. 2 is a functional block diagram of a low-band, dual-polarization antenna system 10 applicable for a radar seeker application. The antenna system 10 includes a first low-frequency array antenna 12 including array radiating elements 16–22 in each of the four quadrants of an aperture, and a second low-frequency antenna 14 including array radiating elements 24–30 in each of the four quadrants of the same aperture.

For the radar transmitting mode, a signal is applied to the SUM channel at a radar electronic interface 34. The signal is distributed through a suitable monopulse feed network 36 behind the antenna 12 to the array radiating elements 16–20. Outgoing signals from the elements 16–22 pass through the transparent, high-band dual reflector antenna system (discussed below), free space and impinge upon a target. A portion of the reflected signal from the target travels in the reverse direction of the transmitting path back to the antenna 12. The reflected signals from free space passing through the high-band, transparent dual reflector antenna system are received by the array elements 16–22. The received signals are transferred to the monopulse feed network 36 through the four monopulse channels (Elevation, summation, azimuth and Q) to the radar system behind the interface 34 for further processing.

Transmitted and received signals for the antenna 14 travel in a similar manner through the various medium in its own signal path. The signals from a monopulse feed network 38, including the four monopulse channels, are transmitted by the radiating elements 24–30. In this example, both of the antennas 12 and 14 operate at the same frequency band, but have orthogonal polarization modes (co-polarization and cross-polarization), either linearly or circularly polarized.

FIG. 3 is a functional block diagram of a high-band, dual-polarization antenna system 42 also applicable for a radar seeker application. The antenna system 42, when standing alone, includes a single physical dual-reflector antenna with a dual-polarized feed subsystem using the same frequency band to provide two separate antenna functions. The SUM, EL, AZ and Q channels are applied to a first polarization circuit 46 for polarizing the signals in a co-polarization mode. Additionally, the SUM, EL, AZ and Q channels are applied to a second polarization circuit 48 for polarizing the signals in the orthogonal polarization (cross-polarization) mode. Because the two antenna functions in the high-band antenna system 42 use the same frequency band, the two polarization modes can be combined and transmitted by a single feed subsystem 50, such as a four-horn feed, with each feed being a dual linearly polarized horn. The feed subsystem 50 is positioned at the center of a main reflector 56 of a dual reflector system 52. The signals emitted by the feed subsystem 50 are reflected off of a sub-reflector 54 of the dual reflector system 52, then off of the main reflector 56 and pass through a support surface 58 and then travel toward free space.

The phase center of the feed subsystem 50 is located at one of the foci of the dual reflector antenna system (the feed location). For easy packaging purpose, the feed location is normally designed at the apex of the main reflector 56 where an opening 57 is provided for accommodating the feed subsystem 50 and/or the RF connections from the two monopulse polarization circuits 46 and 48 to the feed subsystem 50. If the two antenna function in the antenna system 42 operate at different frequency bands, a more complex feed subsystem would be necessary.

The combination of the antenna systems 10 and 42 provide a dual-frequency/dual-polarization antenna system, as a minimum, that has application for a radar sensor for use in connection with tactical missiles for target acquisition and tracking purposes. The redundancy in polarization modes in the various full monopulse functions at different frequencies provides anti-jamming capability. One of the antenna functions would be the primary channel, and would be used for acquisition and targeting. If the radar system determines that the selected primary signal is jammed by a jammer, it can switch to another polarization mode to defeat the jamming threat. The radar system can also select between the low-band antenna system 10 and the high-band antenna system 42, usually depending on the frequency bands being used and the distance between the missile and the target, for the end-game engagement and/or target profiling. Different frequency bands can be used for the systems 10 and 42, such as L-band through millimeter-band, etc., as would be appreciated by those skilled in the art. For non-radar applications, such as communications and remote-sensing applications, a simpler feed circuit would replace the full monopulse feed circuit of the radar application with each separate antenna.

According to the present invention, the two antenna systems 10 and 42 are combined so that the low-band antenna system 10 is positioned behind the high-band dual reflector antenna system 42, where all four antennas use a common boresight defined by the main reflector 56. In order to provide this combined antenna system, the sub-reflector 54, the main reflector 56, and the support surface 58 are frequency selective surfaces (FSS) to reflect the signals at desirable frequency bands and be transparent to the other frequency bands with minimal loss or attenuation. Particularly, the sub-reflector 54 and the main reflector 56 must reflect frequencies transmitted and received by the monopulse feed subsystem 50, the sub-reflector 54 and the main reflector 56 must be transparent to the frequencies transmitted and received by the low-band array radiating elements 16–30 of antennas 12 and 10, and the support surface 58 must be transparent to all of the signals transmitted and received by the combination of the antenna systems 10 and 42.

FIG. 4 is a diagrammatic representation of a multi-band, dual-polarization antenna system 80 for use as a radar seeker. The antenna system 80 includes a dual reflector system 82 having a parabolic-shaped main reflector 84, a sub-reflector 86, and a support cone 88, a low-band dual-polarization antenna 96 which can be the feed elements 16–30 discussed above. A high-band, dual-polarization monopulse feed 90, a low-band monopulse feed 92 for one polarization mode, and a low-band monopulse feed 94 for another polarization mode are positioned behind the reflector system 82 and the low-band antenna 96. The monopulse feeds 90, 92 and 94 represent the feed networks 46, 48, 36 and 38, discussed above, and are known feeds that provide the EL, SUM, AZ and Q radar channels at each frequency bands. In one embodiment, the antenna 96 is a waveguide slotted array that includes two sets of interleaved, orthogonally polarized radiating slots and their associated monopulse feed network. The monopulse waveguide slotted array antenna must tolerate a high-band monopulse feed to be physically passing through the center of its aperture with minimum performance degradation.

As discussed above, the sub-reflector 86 and the main reflector 84 are made of one FSS that is reflective to the high-frequency band and is transparent to the low frequency band. The support cone 88 is made of another FSS so that it is transparent to both the low and high frequency bands. The FSS design can provide minimal losses when it is transparent to the low-band or high-band signals, typically in the range of 0.5 to 1.0 dB, and have a minimum perturbation to the low-band antenna patterns. The design principles, fabrication materials and manufacture processes of FSS demonstrated at lower frequency bands, such as those discussed in the patents referenced above, can be directly applied to millimeter wave frequency bands without much difficulty.

FIG. 5 is a diagrammatic representation of an antenna system 100 that is similar to the antenna system 80 discussed above, where like components are identified with the same reference numeral. In this embodiment, the reflector network 82 is replaced by a reflector network 102 that includes a flat main reflector 104 instead of the parabolic main reflector 84 above. The flat main reflector design possesses a unique and important characteristic to collimate the incident signal from different incident angles towards a single direction, and is also dichroic. U.S. Pat. No. 4,905,014 discloses an antenna system having a flat main reflector that provide these advantages.

Figure 6:
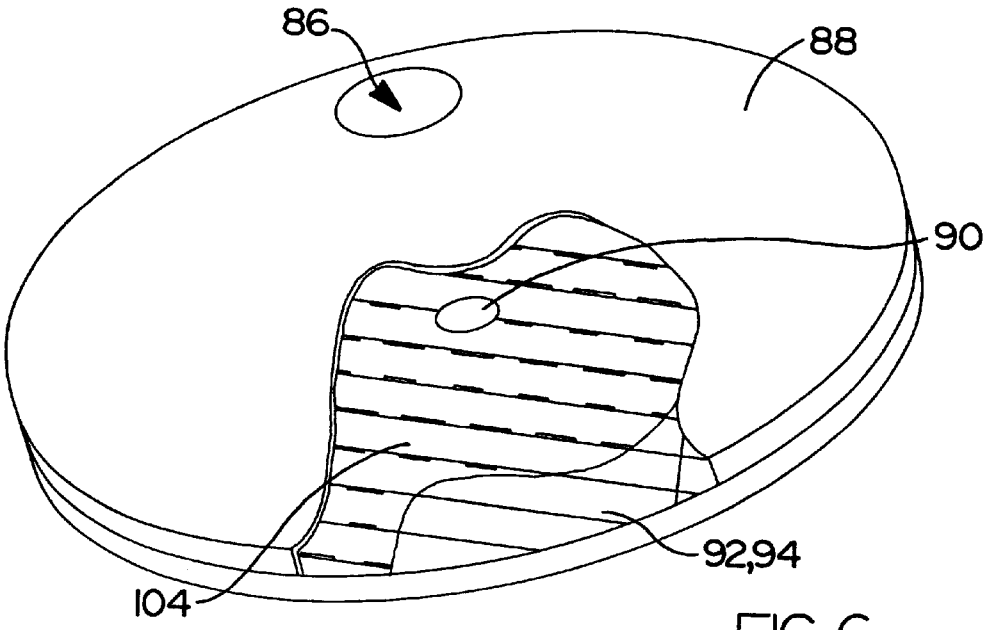
FIG. 6 is a cut-away, perspective view of an assembly package for the dual-band, dual-polarization antenna system shown in FIG. 5.

FIG. 6 is a broken-away illustration of an assembly packaging for the antenna system 100 discussed above, where the same components are labeled with the same reference numerals. In this embodiment, a low-band waveguide slotted array is used. The low-band waveguide slotted array is a self-contained metallic antenna in a single compact sub-assembly. The flat main reflector 104 is bonded onto the low-band antenna aperture with or without a dielectric spacer. The high-band sub-reflector 86 and the support cone 88 are bonded together with precision to form a single component. The sub-reflector/support-cone component is in turn mounted peripherally to the low-band antenna subassembly with precision to ensure the high-band antenna RF performance, such as gain, radiation patterns and beam boresight. A dual-band, dual-polarization and full monopulse antenna system with a waveguide slotted array at Ka-Band of a linear polarization and a Cassegrain reflector antenna with a flat main reflector at W-Band at the orthogonal linear polarization has been demonstrated with satisfactory performance for both bands. The support cone is a dielectric thin shell in stead of a FSS structure and the sub-reflector employs linear wire arrangement in stead of FSS surface for reflecting co-polarization signals and passing through the cross-polarization signals in this demonstration.

The foregoing discloses and describes merely exemplary embodiments of the present invention. One skilled in the art will readily recognize from such discussion and from the accompanying drawings and claims, that various changes, modifications or variations can be made therein without departing from the spirit and scope of the invention as defined in the following claims.

What is claimed is:

1. A multiple-band, polarization-diversified antenna system for transmitting and receiving a plurality of RF signals through a common physical aperture and a common boresight, said system comprising:

a first antenna including a first feed network for transmitting and receiving RF signals in one frequency band and polarization mode;

a second antenna including a second feed network for transmitting and receiving RF signals in at least one frequency band and polarization mode; and a dual reflector antenna for transmitting and receiving RF signals in at least one frequency band, where the frequency band used by the reflector antenna is different than the frequency band used by the first or second antenna, said reflector antenna being positioned in front of the first and second antennas, said dual reflector antenna including a first surface, a second surface, a support surface and a reflector feed subsystem, said first and second surfaces being reflective to the RF bands transmitted and received by the reflector feed subsystem and being substantially transparent to the RF bands transmitted and received by the first and second antennas, and said support surface being substantially transparent to the RF bands transmitted and received by the first and second antennas and the dual reflector antenna.

2. The system according to claim 1 wherein the first and second antennas transmit and receive signals in two separate polarization modes in the same frequency band and the reflector antenna transmits and receives signals in two separate polarization modes in the same frequency band.

3. The system according to claim 1 wherein the first and second antennas transmit and receive signals in two separate frequency bands and the reflector antenna transmits and receives signals in two separate frequency bands.

4. The system according to claim 1 wherein the first and second antennas transmit and receive signals in two separate polarization modes and the reflector antenna transmits and receives signals in two separate frequency bands.

5. The system according to claim 1 wherein the first and second antennas transmit and receive signals in two separate frequency bands and the reflector antenna transmits and receives signals in two separate polarization modes.

6. The system according to claim 1 wherein the reflector antenna includes a high-band monopulse feed for transmitting and receiving signals in two orthogonal polarization modes and the first feed network includes a first low-band monopulse feed for one polarization mode in a low-band and the second feed network includes a second low-band monopulse feed for an orthogonal polarization mode in the low-band.

7. The system according to claim 6 wherein the reflector feed subsystem is positioned at the center of the first surface.

8. The system according to claim 1 wherein the system is used for a radar sensor and wherein the first, second and reflector antennas transmit and receive signals in elevation, summation, azimuth and Q channels.

9. The system according to claim 1 wherein the first surface is selected from the group consisting of flat reflectors and parabolic reflectors.

10. The system according to claim 9 wherein the second surface is a sub-reflector that receives signals from the feed subsystem and reflects the signals to be reflected off of the first surface.

11. The system according to claim 1 wherein the support surface is cone shaped.

12. A multiple band, polarization-diversified radar antenna system for transmitting and receiving a plurality of RF antenna signals in four separate antennas sharing a common physical aperture and with a common boresight, said system comprising:

a dual low-band antenna including a first low-band monopulse feed for generating a first low-band antenna signal in one polarization mode and a second low-band monopulse feed for generating a second low-band antenna signal in an orthogonal polarization mode in a low frequency band; and a high-band reflector antenna including a high-band, dual-polarization monopulse feed subsystem for generating two antenna channel signals with two orthogonal polarization modes, said reflector antenna further including a reflector subsystem including a main reflector, a sub-reflector and a support cone, said high-band monopulse feed subsystem including at least one high-band feed element positioned at the center of the main reflector, said first and second low-band monopulse feeds and said high-band monopulse feed subsystem being positioned behind the reflector subsystem, wherein the main reflector and the sub-reflector are frequency selective surfaces that reflect the high-band signals and are substantially transparent to the low-band signals, and the support cone is a frequency selective surface that is substantially transparent to the low-band signals and the high-band signals.

13. The system according to claim 12 wherein the main reflector is selected from the group consisting of flat reflectors and parabolic reflectors.

14. The system according to claim 13 wherein the sub-reflector receives signals from the feed subsystem and reflects the signals to be reflected off of the main reflector.

15. The system according to claim 12 wherein the first and second low-band monopulse feeds and the high-band monopulse feed transmit and receive radar signals in elevation, summation, azimuth and Q channels.

16. The system according to claim 12 wherein the first and second low-band monopulse feeds are waveguide slotted arrays.

17. A method of transmitting and receiving signals in several separate antenna subsystems sharing a common physical aperture and with a common boresight, said method comprising the steps of:

transmitting and receiving RF signals in one frequency band and polarization mode in a first antenna subsystem;

transmitting and receiving RF signals in one frequency band and polarization mode in a second antenna subsystem;

transmitting and receiving RF signals in at least one frequency band and at least one polarization mode in a reflector antenna subsystem, where the frequency band used by the reflector antenna subsystem is different than the frequency band used by the first and second antenna subsystems;

directing signals from a feed subsystem in the reflector antenna subsystem towards a first frequency selective surface;

reflecting the signals from the feed subsystem off of the first surface towards a second frequency selective surface;

reflecting the signals from the first surface off of the second surface;

directing the signals reflected off of the second surface through a third frequency selective surface; and directing signals from the first and second antenna subsystems through the first frequency selective surface, the second frequency selective surface and the third frequency selective surface.

18. The method according to claim 17 wherein the step of transmitting and receiving signals in the reflector antenna subsystem includes providing a reflector antenna that generates high-band signals in two orthogonal polarization modes in the same frequency band and wherein the steps of transmitting and receiving signals in the first and a second antenna subsystems includes providing first and second antenna subsystems that generate low-band frequency signals in two orthogonal polarization modes in the same frequency band.

19. The method according to claim 17 wherein the step of transmitting and receiving signals in the reflector antenna includes providing a high-band, dual-polarization monopulse feed network, the step of transmitting and receiving signals in a first antenna subsystem includes providing a first low-band monopulse feed network and the step of transmitting and receiving signals in a second antenna subsystem includes providing a second low-band monopulse feed network.

20. The method according to claim 17 wherein the step of transmitting and receiving signals in a reflector antenna includes providing the first frequency selective surface as a sub-reflector of a reflector antenna, the second frequency selective surface as a main reflector of the reflector antenna, and the third frequency selective surface as a support surface for the sub-reflector of the reflector antenna, said method further comprising the step of positioning the feed subsystem at the center of the main reflector.

* * * * *